US005288066A

United States Patent [19]

Hain

[11] Patent Number: 5,288,066

[45] Date of Patent: Feb. 22, 1994

[54] APPARATUS AND METHOD FOR LOADING SHEETS INTO A RECEPTACLE

[75] Inventor: David A. Hain, Monifieth, Scotland

[73] Assignee: NCR Corporation, Dayton, Ohio

[21] Appl. No.: 959,826

[22] Filed: Oct. 13, 1992

[30] Foreign Application Priority Data

Apr. 10, 1992 [GB] United Kingdom ..... 9207929

[51] Int. Cl.[5] ..... B65H 29/44

[52] U.S. Cl. ..... 271/181; 271/198; 271/213; 271/214; 271/176

[58] Field of Search ..... 271/151, 177, 178, 180, 271/181, 182, 176, 213-216, 198, 202, 203, 176

[56] References Cited

U.S. PATENT DOCUMENTS

| | | | |
|---|---|---|---|
| 3,001,789 | 9/1961 | Emslie et al. | 271/215 |
| 4,275,874 | 6/1981 | DiBlasio . | |
| 4,296,684 | 10/1981 | Wangermann | 271/177 X |
| 4,346,881 | 8/1982 | Frye | 271/202 X |
| 4,501,416 | 2/1985 | Hain . | |
| 4,510,380 | 4/1985 | Uchida et al. . | |
| 4,552,351 | 11/1985 | Tsukamoto . | |
| 4,682,768 | 7/1987 | Iida et al. . | |
| 4,704,061 | 11/1987 | Peebles . | |
| 4,809,966 | 3/1989 | Kobayashi et al. | 271/181 |
| 4,809,967 | 3/1989 | Kondo | 271/213 X |
| 4,913,341 | 4/1990 | Bachman . | |
| 4,984,677 | 1/1991 | Prakken | 271/151 X |

FOREIGN PATENT DOCUMENTS

| | | | |
|---|---|---|---|
| 0213094 | 6/1986 | European Pat. Off. . | |
| 0221500 | 10/1986 | European Pat. Off. . | |
| 0263712 | 10/1987 | European Pat. Off. . | |
| 0385651 | 2/1990 | European Pat. Off. . | |
| 635787 | 9/1936 | Fed. Rep. of Germany | 271/181 |
| 122197 | 9/1979 | Japan | 271/215 |
| 56253 | 3/1987 | Japan | 271/215 |
| 106535 | 4/1990 | Japan | 271/176 |
| 8707059 | 11/1987 | PCT Int'l Appl. | 271/180 |
| 1047055 | 11/1966 | United Kingdom | 271/181 |
| 2198122 | 6/1988 | United Kingdom . | |
| 2247097 | 6/1991 | United Kingdom . | |

*Primary Examiner*—D. Glenn Dayoan
*Assistant Examiner*—Boris Milef
*Attorney, Agent, or Firm*—Elmer Wargo

[57] ABSTRACT

An apparatus for automatically loading currency notes (11) into a currency cassette (12) includes first endless belt feeder (54, 56) for feeding notes (11) to an entry nip of second endless belt feeder (76, 78). Each note (11) fed to the second feeder (76, 78) passes over part of the periphery of a pulley (74) associated with the second feeder (76, 78), whereby, when the trailing portion of the note (11) moves out of engagement with the first feeder (54), this portion is deflected away from the feed path defined by the first feeder (54, 56). The second feeder (76, 78) is driven in an intermittent manner, so that notes are fed by the second feeder (76, 78) in overlapping manner into the open top of the cassette (12). Pusher arms project into an open end of the cassette and are periodically operated so as to push notes already present in the cassette (12) into the interior thereof away from said end.

17 Claims, 6 Drawing Sheets

APPARATUS AND METHOD FOR LOADING SHEETS INTO A RECEPTACLE

BACKGROUND OF THE INVENTION

1. Field of Invention

This invention relates to an apparatus and method for loading sheets into a receptacle. The invention has application, for example, to an apparatus for loading currency notes into a currency cassette.

2. Background Information

Currency cassettes are used, for example, in automated teller machines (ATMs) of the kind wherein a user inserts a customer identifying card into the machine and then enters certain data (such as codes, quantity of currency required or to be paid in, type of transaction, etc.) upon one or more keyboards associated with the machine. The machine will then process the transaction, update the user's account to reflect the current transaction, dispense cash, when requested, extracted from one or more currency cassettes mounted in the machine, and return the card to the user as part of a routine operation. It is common for an ATM to dispense currency notes of at least two different denominations, in which case the ATM will normally include a separate currency cassette for notes of each particular denomination.

It is important for the correct operation of the cash dispensing mechanism of an ATM that the currency notes contained in each currency cassette mounted in the ATM are of a suitable condition for handling by the cash dispensing mechanism. For example, if currency notes contained in a currency cassette are torn, are extremely limp, or have foreign matter such as adhesive tape or staples attached to them, then there is a risk that such notes may become jammed in the associated cash dispensing mechanism. Thus, care must be taken when loading currency cassettes that unsuitable notes should be excluded.

The manual loading of currency notes into a cassette can be tedious and time-consuming. Accordingly, the need exists for a means for facilitating or automating the loading of currency cassettes. From GB Patent 2198122-A there is known an apparatus for automatically loading notes into a currency cassette, the apparatus including a carriage which is reciprocally movable between a stacking position remote from the cassette and a loading position adjacent an open end of the cassette. In operation, a stack of notes is formed on the carriage at the stacking position and carried by the carriage to the loading position. During a return movement of the carriage to the stacking position, this stack is laid down into the open end of the cassette. A disadvantage of this known apparatus is that it is of complex construction.

SUMMARY OF THE INVENTION

It is an object of this invention to provide an apparatus which is arranged to load sheets into a receptacle in an automatic manner, and which is of simple construction.

In a first aspect of a preferred embodiment of this invention, there is provided an apparatus comprising:

a receptacle for storing sheets;

moving means for moving said receptacle between loading and unloading positions in said apparatus;

said receptacle having a front end and a pusher plate means including a pusher plate for resiliently biasing sheets loaded into said receptacle towards said front end;

feeding means for feeding said sheets in overlapping relationship between said front end and said pusher plate when said receptacle is in said loading position; and pusher arm means for pushing sheets fed between said front end and said pusher plate towards said pusher plate.

In another aspect of this invention, there is provided a method of loading sheets into a receptacle in an apparatus, with said receptacle having a front end and a pusher plate for biasing sheets fed into said receptacle towards said front end; said method comprising the steps of:

(a) moving the receptacle from an unloading position to a loading position in said apparatus;

(b) feeding the sheets in overlapping relationship so that a discharge end of said overlapping sheets is positioned between said front end and said pusher plate when said receptacle is in said loading position; and (c) periodically pushing the overlapping sheets fed into said receptacle towards said pusher plate.

It should be understood that an apparatus made in accordance with the present invention could form part of a cash management system in which currency notes are screened for the purpose of detecting and rejecting notes of unsuitable condition prior to the notes being loaded automatically into a currency cassette.

A preferred embodiment of the invention will now be described by way of example with reference to the accompanying specification, claims, and drawing.

DETAILED DESCRIPTION OF THE PREFERRED EMBODIMENT

Figure 1:
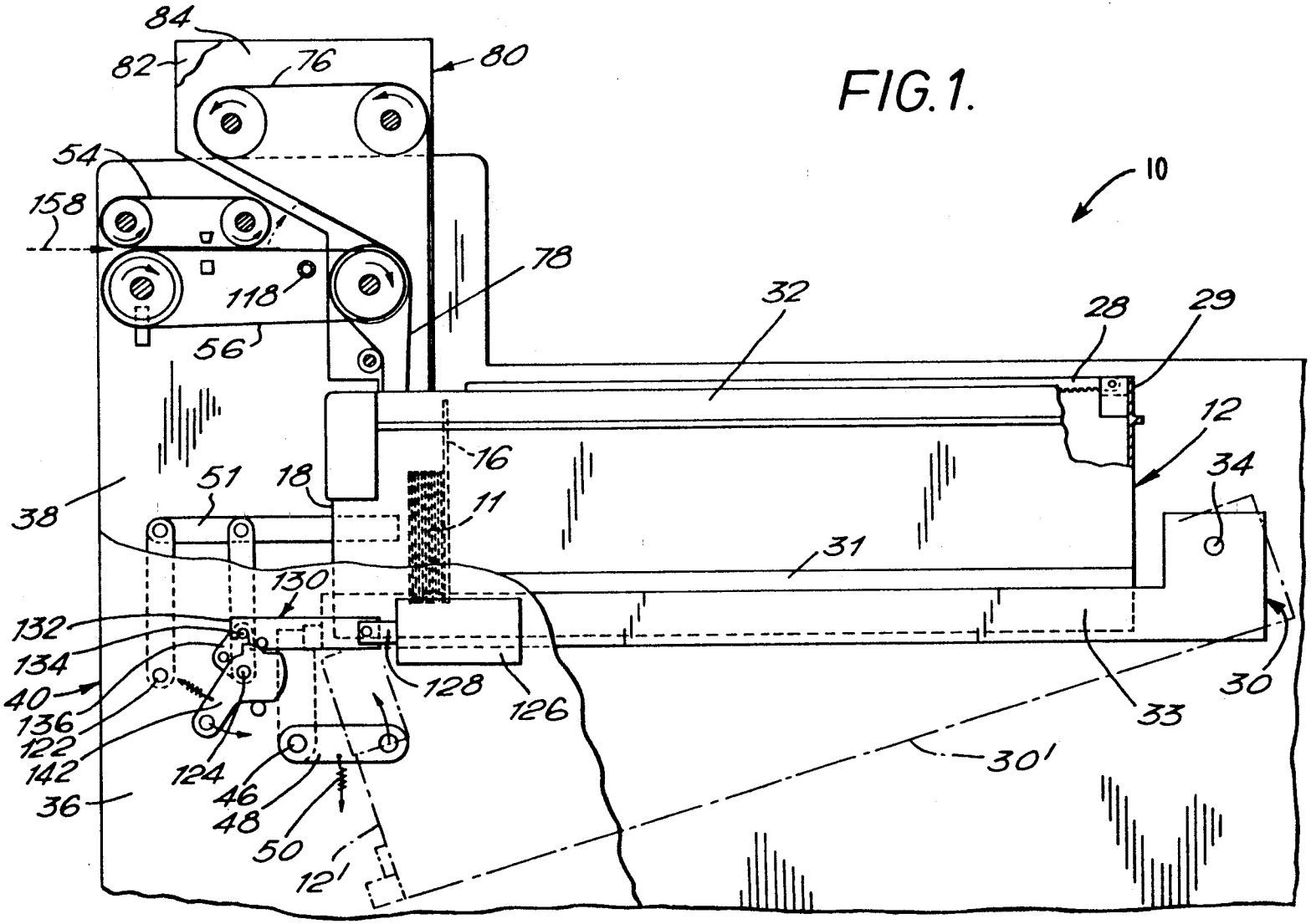
FIG. 1 is a side elevational view, partly broken away, showing a currency cassette mounted in a loading apparatus for automatically loading currency notes into the cassette.
Figure 2:
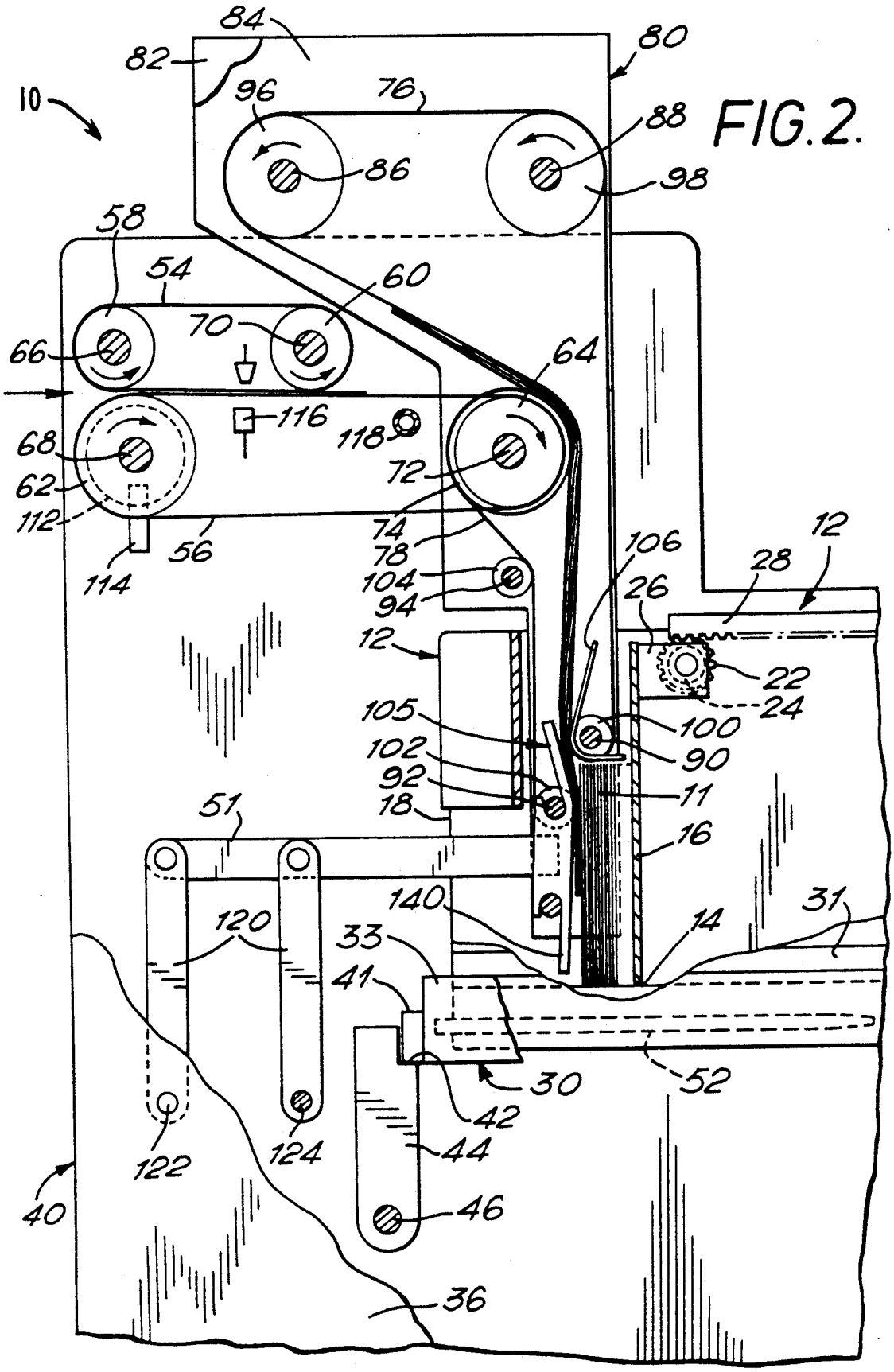
FIG. 2 is an enlarged, partly sectional, side elevational view, again partly broken away, of part of the cassette and loading apparatus shown in FIG. 1.
Figure 3:
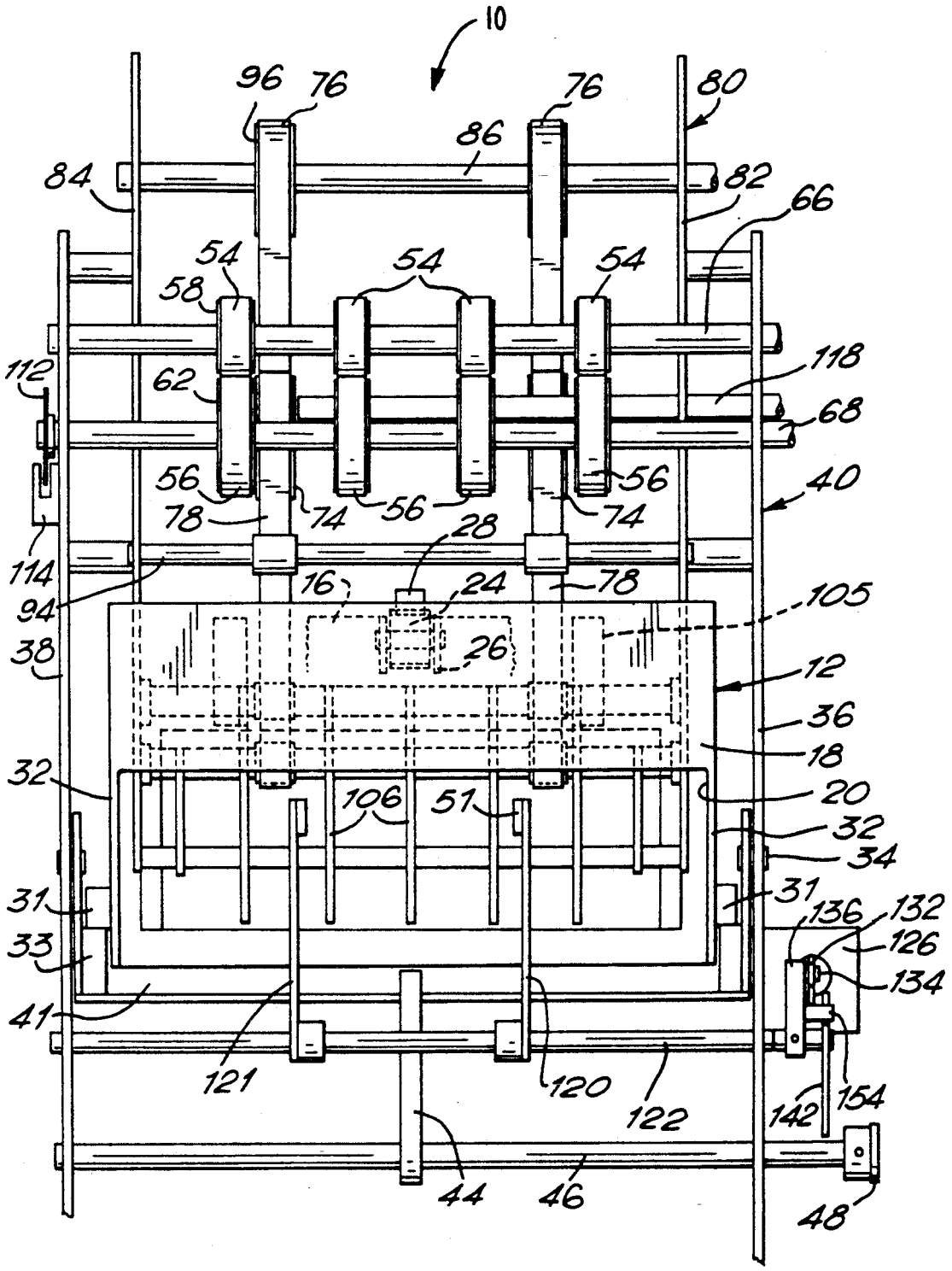
FIG. 3 is a front elevational view of the cassette and loading apparatus, the view being from left to right with reference to FIGS. 1 and 2.

Referring to FIGS. 1 to 4 of the drawing, there is shown therein an apparatus 10 for loading currency notes 11 into a currency cassette 12. Apart from a modification which will be described later, the cassette 12 is of a type which is well known in the art. The cassette 12 includes a floor member 14 (FIG. 2) for supporting corresponding long edges of a stack of currency notes 11 housed in the cassette 12, and a pusher plate 16 which is slidably mounted on the floor member 14 and which is arranged to urge the stack of notes 11 under the action of spring means (not shown) towards an end wall 18 of the cassette 12. As seen in FIG. 3, in the end wall 18 there is provided an opening 20 thorough which notes 11 may be withdrawn one by one in conventional manner when the cassette 12 is mounted in an operational position in a cash dispensing apparatus (not shown) of an ATM. Normally, when the cassette 12 is not mounted in a cash dispensing apparatus, the opening 20 is closed by a flexible shutter (not shown). In a manner that is well known in the art, when the cassette 12 is mounted in a cash dispensing apparatus, the shutter is removed from the opening 20 to a position beneath the floor member 14 under the action of key pins included in the cash dispensing apparatus. The cassette 12 is provided with a lid (not shown) which is normally locked in a closed position. It should be understood that when the cassette 12 is mounted on the apparatus 10, the lid is removed from the remainder of the cassette 12.

The above-mentioned modification involves a gear wheel 22 (FIG. 2) mounted on a one-way rotational clutch 24, the clutch 24 being mounted on brackets 26 secured to an upper portion of the pusher plate 16. When the cassette 12 is mounted in the apparatus 10, the gear wheel 22 engages a rack member 28 which is pivotably attached at one end in a removable manner to an end wall 29 (FIG. 1) of the cassette 12 opposite the end wall 18, and which is held in engagement with the gear wheel 22 by virtue of the weight of the rack member 28. The clutch 24 permits rotation of the gear wheel 22 in a counterclockwise counter direction only (with reference to FIG. 2), so that while the gear wheel 22 is in engagement with the rack member 28, the pusher plate 16 can move only from left to right with reference to FIGS. 1 and 2, i.e. away from the end wall 18. It should be understood that, when the cassette 12 is removed from the apparatus 10, the rack member 28 is removed from the cassette 12 prior to the lid being locked in position on the cassette 12. Thus, in normal operation of the cassette 12, the rack member 28 is not present in the cassette 12 so that the pusher plate 16 can be moved towards the end wall 18 under the action of the previously mentioned spring means.

When the cassette 12 is mounted in a loading position in the apparatus 10, the cassette 12 is supported on a support member 30, with horizontally extending ridge members 31 (FIG. 3) respectively provided on side walls 32 of the cassette 12 respectively resting on horizontally extending support bars 33 of the support member 30. The rear end of the support member 30 (i.e. the right hand end with reference to FIGS. 1 and 2) is pivotably mounted on studs 34 respectively secured to side walls 36 and 38 of a supporting framework 40. A front end portion 41 of the support member 30 is supported by a shoulder 42 (FIG. 2) formed on a latch member 44 which is secured on a shaft 46 extending between, and rotatably mounted with respect to, the side walls 36 and 38. One end of a lever 48 is secured to a portion of the shaft 46 projecting beyond the side wall 36, and the latch member 44 is normally held in engagement with the support member 30 under the action of a spring 50 (FIG. 1). When the cassette 12 is correctly supported on the support member 30, the front end wall 18 of the cassette 12 engages the front end portion 41 of the support member 30, the cassette 12 being held in this position by manually releasable latch means (not shown). As will be described in more detail later, the free ends of two horizontally mounted pusher arms 51 project into the interior of the cassette 12 through the opening 20.

After the cassette 12 has been loaded with notes 11 by the apparatus 10 in a manner to be described later, the cassette 12 can be removed from the apparatus 10 by manually pivoting the lever 48 in a counterclockwise direction (with reference to FIGS. 1 and 2) against the action of the spring 50 so as to disengage the latch member 44 from the front end of the support member 30, and by manually retracting the pusher arms 51 to the position shown in FIG. 4 in which the free ends of the arms 51 are clear of the cassette 12. Following the disengagement of the latch member 44 from the support member 30 and following the retraction of the pusher arms 51, the assembly of the cassette 12 and the support member 30 can be pivoted in a counterclockwise direction into the positions 12' and 30' shown in chain outline in FIG. 1, in which position the cassette 12 is clear of the loading apparatus 10. The cassette 12 can now be removed from the apparatus 10 by sliding the cassette 12 along the support member 30 away from the end portion 41. The cassette 12 can be remounted in the loading apparatus 10 by sliding the cassette 12 back along the support member 30 towards the end portion 41 with the support member 30 still in the position 30' shown in dashed outline in FIG. 1. It should be understood that the support member 30 is provided with two prongs 52 (FIG. 2).which extend rearwardly away from the front portion 41 parallel to the support bars 33, the prongs 52 corresponding in function to the previously mentioned key pins of the cash dispensing apparatus (not shown) in which the cassette 12 is intended to be mounted. Thus, during the remounting of the cassette 12 in the loading apparatus 10, the prongs 52 serve to open the shutter of the cassette 12. After the cassette 12 has been latched in position on the support member 30 with the front wall 18 of the cassette 12 in engagement with the front portion 41 of the support member 30, the assembly of the cassette 12 and support member 30 is pivoted in a clockwise direction into the position shown in FIG. 2, with the front portion 41 held by the latch member 44.

The loading apparatus 10 includes upper and lower sets of cooperating endless feed belts 54 and 56, the belts 54 passing around respective front pulleys 58 and respective rear pulleys 60, and the belts 56 passing around respective front pulleys 62 and respective rear pulleys 64. It should be understood that lower portions of the belts 54 extending between the pulleys 58 and 60 are, respectively, in cooperative relationship with respect to upper portions of the belts 56. The set of front pulleys 58 and the set of front pulleys 62 are, respectively, secured on two drive shafts 66 and 68 which extend between, and are rotatably mounted with respect to, the side walls 36 and 38. The set of rear pulleys 60 and the set of rear pulleys 64 are, respectively, rotatably mounted on two additional shafts 70 and 72 which extend between the side walls 36 and 38, the shaft 72 being rotatably mounted with respect to the side walls 36 and 38. Two additional pulleys 74, which have a diameter slightly greater than that of the pulleys 64, are secured on the shaft 72 which serves as a drive shaft for the pulleys 74. As will be explained later, the pulleys feed belts 74 are respectively associated with a pair of endless feed belts 76 and with a pair of endless feed belts 78, the pairs of belts 76 and 78 being mounted in cooperative relationship with respect to each other.

An additional supporting framework 80 (FIG. 2), having side walls 82 and 84, is mounted between the side walls 36 and 38 of the framework 40. A drive shaft 86 extends between, and is rotatably mounted with respect to, the side walls 82 and 84, and additional shafts 88, 90, 92, and 94 extend between the side walls 92 and 84. A pair of pulleys 96 is secured on the drive shaft 86, and additional pairs of pulleys 98, 100, 102, and 104 are, respectively, rotatably mounted on the shafts 88, 90, 92, and 94. As best seen in FIG. 2, each of the belts 76 passes around associated ones of the pulleys 96, 98, and 100 and over part of the periphery of an associated one of the pulleys 74. Each of the belts 78 passes around associated ones of the pulleys 74 and 102 and over part of the periphery of an associated one of the pulleys 104. It should be understood that parts of the belts 76 extending between the pulleys 74 and 100 are respectively in cooperative relationship with respect to parts of the belts 78, extending between the pulleys 74 and 102. Guide means 105 and 106 are mounted on the framework 80 on opposite sides of the cooperating parts of the belts 76 and 78.

Figure 10:
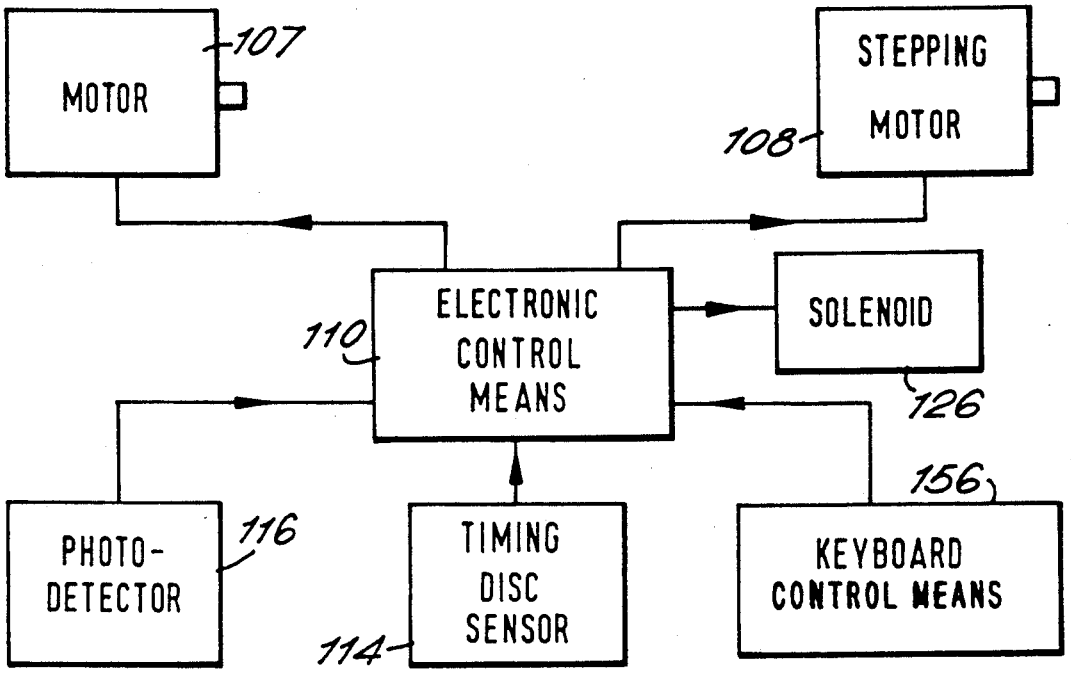
FIG. 10 is a block circuit diagram showing electrical interconnections of parts of the loading apparatus.

Referring now additionally to FIG. 10, the drive shafts 66 and 68 are driven via gear means (not shown) by an electric motor 107, and the drive shafts 72 and 86 are driven via gear means (not shown) by an electric stepping motor 108. Operation of the motors 107 and 108 is controlled by electronic control means 110 forming part of the loading apparatus 10. In operation of the loading apparatus 10, the cooperating feed belts 54 and 56 are continuously driven by the motor 107, while the cooperating feed belts 76 and 78 are intermittently driven by the stepping motor 108, under the control of the electronic control means 110 in a manner to be described later. A timing disc 112 (FIG. 3) is mounted on a portion of the drive shaft 68 projecting beyond the side wall 38, the timing disc 112 being operatively associated with a sensor 114 mounted on the side wall 38. In operation of the loading apparatus 10, the sensor 114 applies a series of time pulses to the electronic control means 110. Photodetector means 116 (FIG. 2) are positioned in the region of the cooperating parts of the belts 54 and 56 for a purpose which will be explained later. A tube 118 connected to an air pump (not shown) is positioned beneath the upper parts of the belts 56 extending between the pulleys 60 and 64. In operation, upwardly directed air jets are emitted by the tube 118 via orifices (not shown) for a purpose which will be explained later.

Figure 4:
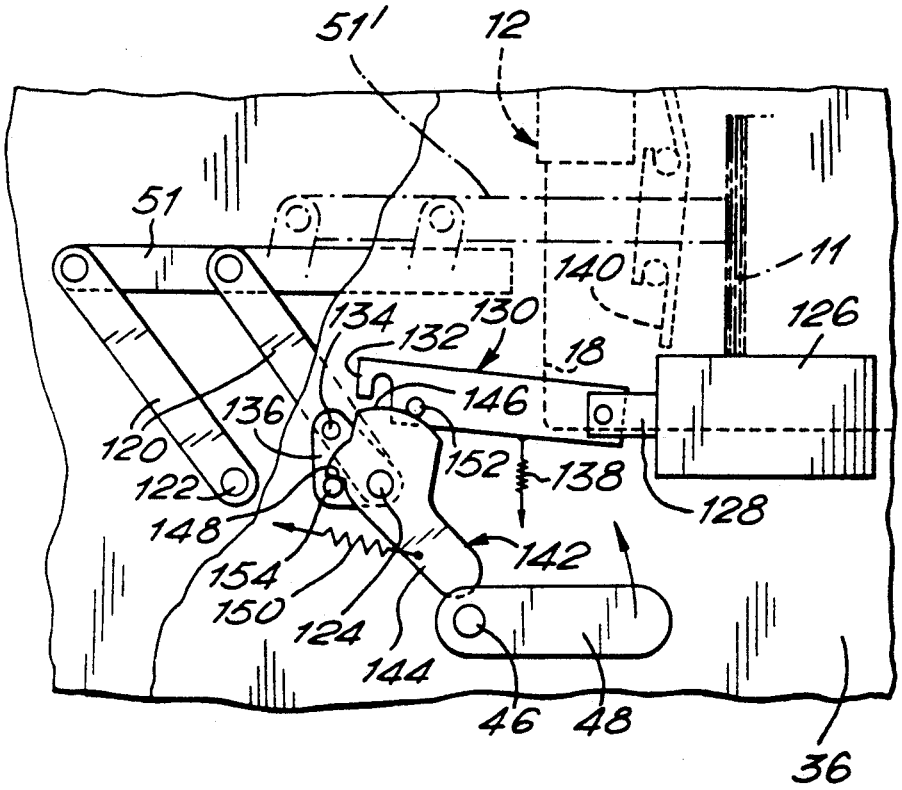
FIG. 4 is an elevational view of a pusher mechanism of the loading apparatus, elements of the pusher mechanism being in different positions from the positions shown in FIG. 1.

The pusher arms 51 (FIGS. 1-3) referred to previously are, respectively, supported by two pairs of parallel support arms 120 and 121, upper ends of each pair of support arms 120 and 121 being pivotably connected to portions of the associated pusher arm 51 spaced from the free end of the arm 51 (the right hand end with reference to FIGS. 1, 2, and 4). The lower ends of each pair of support arms 120 and 121 are, respectively, secured on two shafts 122 and 124 which extend between, and are rotatably mounted with respect to, the side walls 36 and 38. A solenoid 126 (FIGS. 1 and 2) having an armature 128 is mounted on the outside of the side wall 36. The armature 128 is pivotably connected to one end of a link member 130, the other end of which is formed as a hook portion 132. As shown in FIGS. 1 and 3, the hook portion 132 normally engages a stud 134 provided on an arm 136 which is secured on a portion of the shaft 124 projecting beyond the side wall 36, the hook portion 132 being normally held in engagement with the stud 134 by means of a spring 138 (FIG. 4) attached to the link member 130. Normally, when the solenoid 126 is in a de-energized condition, the pusher arms 51 are positioned as shown in FIG. 2 with the free ends of the arms 51 being positioned slightly to the left of lowermost portions 140 of the guide means 105. With regard to the guide means 105, it should be understood that, when the cassette 12 is mounted in a loading position in the loading apparatus 10, part of the framework 80 on which the guide means 105 and 106 are mounted projects into the cassette 12 through the open top thereof with the lowermost portions 140 of the guide means 105 positioned a short distance above the floor member 14 of the cassette 12. Upon the solenoid 126 being energized, the armature 128 draws the link member 130 to the right (with reference to FIGS. 1, 2 and 4) so as to cause the assembly of the arm 136 and shaft 124 to rotate in a clockwise direction which in turn causes the support arms 120 and 121 to pivot in a clockwise direction so as to move the pusher arms 51 into the position 51' shown in dashed outline in FIG. 4 in which the free ends of the arms 51 are positioned to the right of the lowermost portions 140 of the guide means 105. When the solenoid 126 is again de-energized, the assembly of the pusher arms 51 and support arms 120 and 121 is moved back to the position shown in FIGS. 1 and 2 under the action of spring means (not shown).

As previously mentioned, in order to enable the assembly of the cassette 12 and support member 30 to be pivoted into the position shown in chain outline in FIG. 1, it is necessary to retract the pusher arms 51 to the position shown in FIG. 4 in which the free ends of the arms 51 are clear of the front wall 18 of the cassette 12. For the purpose of enabling such retraction of the pusher arms 51 to be carried out, an additional arm 142 is secured on the shaft 124, the arm 142 being positioned on that side of the arm 136 remote from the side wall 36. Referring particularly to FIG. 4, the arm 142 has a handle portion 144, a cam surface 146, and a shoulder 148. In order to retract the pusher arms 51, the arm 142 is manually pivoted in a counterclockwise direction by means of the handle portion 144 from the home position shown in FIG. 1 to the position shown in FIG. 4 against the action of a spring 150. During a first part of this pivotal movement of the arm 142, the cam surface 146 engages a stud 152 on the link member 130 so as to lift the hook portion 132 out of engagement with the stud 134 on the arm 136. Thereafter, during continued pivotal movement of the arm 142, the shoulder 148 engages another stud 154 on the arm 136 so as to bring about rotation of the assembly of the shaft 124 and arm 136 in a counterclockwise direction, which in turn brings about pivotal movement of the support arms 120 and 121 in a counterclockwise direction so as to move the pusher arms 51 into the position shown in solid outline in FIG. 4.

Operation of the loading apparatus 10 will now be described with additional reference to FIGS. 5 through 9. Initially, in response to a signal from manually operated keyboard control means 156 (FIG. 10), the electronic control means 110 energizes the motor 107 so as to cause the feed belts 54 and 56 to commence operation. At the same time, the sensor 114 associated with the timing disc 112 commences to apply timing pulses to the electronic control means 110. Currency notes 11 are fed to the loading apparatus 10, one by one, along a feed path 158 (FIG. 1) into the nip of the feed belts 54 and 56, with the long edges of the notes 11 being perpendicular to the feed path 158. The notes are supplied, for example, from a currency note screening system such as will be subsequently described with reference to FIG. 11. The first note 11, fed to the feed belts 54 and 56, is gripped thereby and fed towards the nip of the cooperating feed belts 76 and 78. In response to the sensing of the leading edge of the note 11', the photodetector means 116 sends a signal to the electronic control means 110. A predetermined time after the receipt of this last mentioned signal, as represented by the counting of a predetermined number of timing pulses by the electronic control means 110, the electronic control means 110 starts the stepping motor 108 so as to cause the feed belts 76 and 78 to commence operation, such operation commencing prior to the leading edge of the first note 11' reaching the nip of the feed belts 76 and 78.

Figure 5:
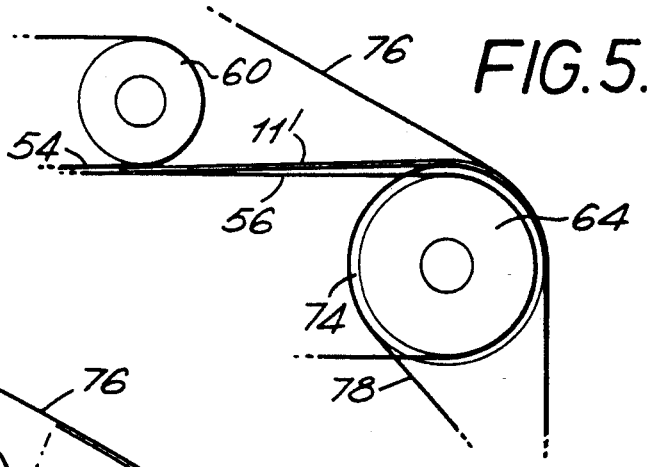
FIGS. 5 through 9 are schematic views, showing different stages in the operation of feeding means for feeding currency notes in overlapping manner to the front end of the currency cassette.
Figure 6:
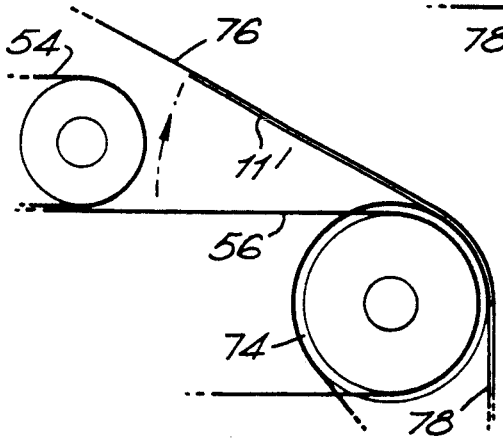

The spacing between the pulleys 74 and the pulleys 60 is such that, when the leading edge of the first note 11' reaches the nip of the feed belts 76 and 78 and becomes gripped thereby, the trailing edge of the note 11' is still gripped between the belts 54 and 56, as shown in FIG. 5. It should be understood that, upon a leading portion of the note 11' being gripped and driven by the belts 76 and 78, this portion is bent over part of the periphery of each of the pulleys 74, so that this portion is deflected away from the feed path defined by the cooperating feed belts 54 and 56. Shortly after the leading portion of the note 11' is gripped and driven by the feed belts 76 and 78, the trailing edge of the note 11' moves out of contact with the belts 54, whereupon, as shown in FIG. 6, a trailing portion of the note 11' springs away from the last-mentioned feed path, by virtue of the inherent resilience or stiffness of the note 11', and into contact with the belts 76. The movement of the trailing portion of the note 11' into contact with the belts 76 is assisted by the upwardly directed jets of air from the tube 118 (FIGS. 1 and 2) referred to previously. A further short time after the trailing portion of the note 11' has sprung into contact with the belts 76, the motor 108 is stopped by the electronic control means 110 so as to stop the operation of the drive belts 76 and 78. At this time, the note 11' is stopped with a trailing portion in contact with the belts 76 and positioned above the upper portions of the belts 56, in a position similar to that shown in FIG. 6.

Figure 7:
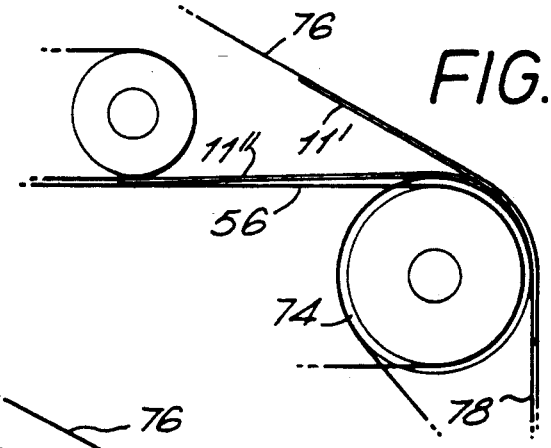
Figure 8:
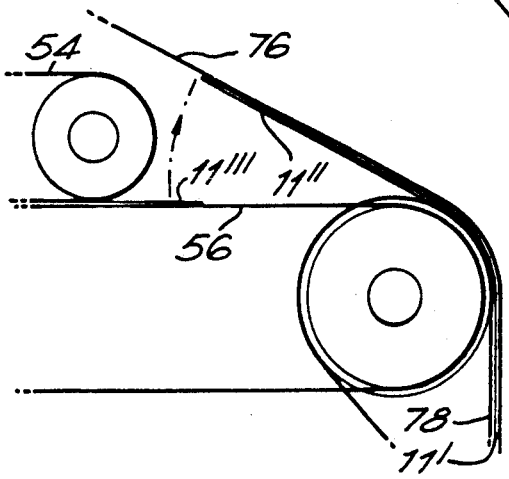

It should be understood that the belts 54 and 56, driven by the motor 107, operate continuously during operation of the loading apparatus 10. Thus, while the first note 11' is stopped as just mentioned, the next note 11' is fed by the belts 54 and 56 towards the nip of the belts 76 and 78. As in the case of the first note 11', the leading edge of the note 11'' is sensed by the photodetector means 116, in response to which a signal is sent by the photodetector means 116 to the electronic control means 110. A predetermined time after receipt of this last-mentioned signal, the electronic control means 110 again starts the stepping motor 108 so as to cause the belts 76 and 78 to recommence operation, this recommencement of operation occurring prior to the leading edge of the note 11'' reaching the nip of the feed belts 76 and 78. Prior to operation of the belts 76 and 78 recommencing, the leading edge of the note 11'' moves beneath the trailing portion of the note 11' positioned above the belts 56 so that a leading portion of the note 11'' is positioned in overlapping relationship with respect to the note 11'. When the operation of the belts 76 and 78 recommences, the two notes 11' and 11'' are fed together, in overlapping relationship, partly around the peripheries of the pulleys 74, as shown in FIG. 7.

Figure 9:
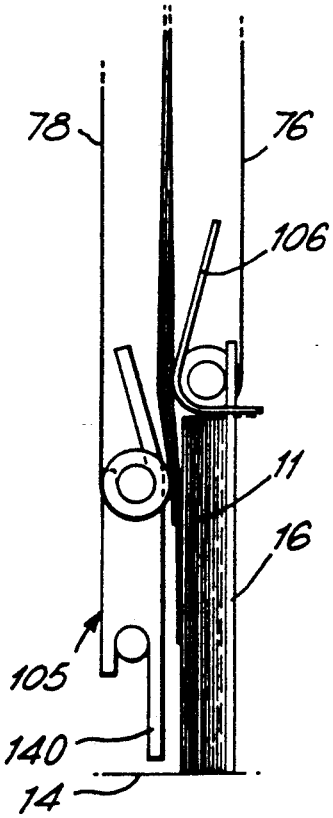

In a similar manner to that described with reference to the first note 11', when the trailing edge of the second note 11'' moves out of contact with the belts 54, a trailing portion of the note 11'' springs away from the feed path defined by the belts 54 and 56 and into contact with the belts 76. Shortly thereafter, the belts 76 and 78 are again stopped with the overlapping notes 11' and 11'' in the overlapping position shown in FIG. 8. The next note 11''' (FIG. 8) is then fed by the belts 54 and 56 to a position in which a leading portion of the note 11''' is in overlapping relationship with respect to the note 111'', and operation of the belts 76 and 78 is then restarted once again. Thus, it will be appreciated that a stream of overlapping notes 11 is fed by the belts 76 and 78 along a feed path defined by the belts 76 and 78 and by the guide means 105 and 106 until the leading edges of the notes 11 abut against the floor member 14 of the currency cassette 12. In this manner, currency notes 11 are fed into the cassette 12 and formed into a stack between the guide means 105 and the pusher plate 16, as shown in FIG. 9, with corresponding long edges of the notes 11 in the stack being supported by the floor member 14.

In order to create room for notes 11 to be fed in continuing manner into the cassette 12, the electronic control means 110 periodically momentarily energizes the solenoid 126 so as to move the pusher arms 51 to the position 51', shown in dashed outline in FIG. 4, such energization taking place, for example, after every tenth note 11 is sensed by the photodetector means 116. Such movement of the pusher arms 51 pushes the stack of notes 11 already in the cassette 12 and supported by the floor member 14 to the right with reference to FIGS. 1, 2, 4 and 9, against the pressure exerted on the stack by the pusher plate 16, and also pushes the plate 16 to the right. As previously explained, the one-way clutch 24 associated with the plate 16 prevents return leftward movement of the plate 16 following de-energization of the solenoid 126 and the return of the pusher arms 51 to their home position shown in FIGS. 1 and 2. It will be appreciated that because the notes 11 are fed into the cassette 12 in an overlapping manner, there is no risk of the leading edge of each successive note 11 hitting, or becoming jammed against, an edge of a preceding note 11. Operation of the pusher arms 51 in the manner just described (including return of their home position) is timed by the electronic control means 110 to take place while the belts 76 and 78 are stopped, so that there is no risk of incoming notes 11 becoming jammed against the pusher arms 51.

Operation of the belts 54 and 56, the belts 76 and 78, and the pusher arms 51 continues in the manner previously described until the loading of currency notes 11 into the cassette 12 by the loading apparatus 10 has been completed, whereupon the electric control means 110 stops both of the motors 107 and 108. The latch member 44 (FIG. 2) is then disengaged from the support member 30 by manual operation of the lever 48, and the pusher arms 51 are moved to a retracted position by manual operation of the handle portion 144 of the arm 142, after which the assembly of the cassette 12 and the support member 30 is pivoted in an counterclockwise direction into the position shown in dashed outline in FIG. 1. The cassette 12 is then withdrawn from the apparatus 10, the rack member 28 is removed from the cassette 12, and the lid (not shown) is locked in position on the cassette 12. During the withdrawal of the cassette 12 from the loading apparatus 10, the shutter (not shown) is automatically returned in conventional manner to its closed position. The loaded cassette 12 is now ready to be transported to an ATM for insertion into the cash dispensing mechanism thereof.

The loading apparatus 10 described above has the advantages of being simple in construction, simple to operate, and reliable in operation.

Figure 11:
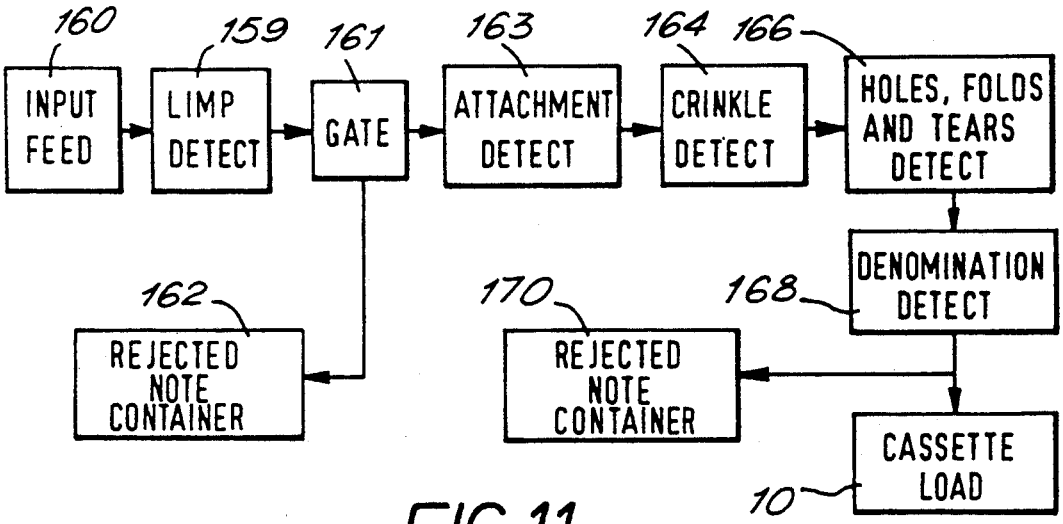
FIG. 11 is a schematic block diagram illustrating features of a currency note screening and loading system incorporating a loading apparatus made in accordance with this invention.

As previously mentioned, the loading apparatus 10 could form part of a currency note screening and loading system such as is shown in FIG. 11. Referring to FIG. 11, the system shown therein incorporates a limp note detect apparatus 159 such as is described, for example, in EP Patent 0470808 A2. The limp note detect apparatus 159 is located downstream of an input feed mechanism 160 which serves to feed currency notes one by one to the apparatus 159 from a stack of notes held in the mechanism 160. Currency notes which are determined by the apparatus 159 as having a stiffness not meeting a required standard are diverted by a gate 161 to a rejected note container 162. Currency notes meeting the required stiffness standard are transported via the gate 161 to a detector 163 which detects the presence of staples or other attachments to the currency notes. After passing through the detector 163, the currency notes are fed, in turn, through a detector 164 which detects crinkles, through a detector 166 which detects holes, folds, and tears, and through a detector 168 which detects the denominational value of the notes. If any of the currency notes is found to be unacceptable by any of the detectors 163, 164, and 166, or is found to be of the wrong denomination by the detector 168, then it is transported along a branch line to an additional rejected note container 170. Otherwise, the note is fed to the loading apparatus 10 where it is loaded into a currency cassette.

What is claimed is:

1. An apparatus comprising:

a receptacle for storing sheets;

moving means for moving said receptacle between loading and unloading positions in said apparatus;

said receptacle having a front end and a pusher plate means including a pusher plate for resiliently biasing sheets loaded into said receptacle towards said front end;

feeding means for feeding said sheets in overlapping relationship between said front end and said pusher plate when said receptacle is in said loading position; and pusher arm means for pushing sheets fed between said front end and said pusher plate towards said pusher plate;

said pusher plate means including a one way clutch coupled to said pusher plate and said receptacle to enable said pusher plate to be moved only in a direction away from said front end by said pusher arm mans when said receptacle is in said loading position.

2. The apparatus as claimed in claim 1 in which said feeding means comprises:

first feeding means for feeding said sheets in spaced relationship in a first direction;

second feeding means for receiving a said sheet from said first feeding means and moving it in a second direction; and control means for controlling the energization of said first feeding means for feeding said sheets continuously, and for controlling the energization of said second feeding means for feeding said sheets intermittently to enable the leading edge of a said sheet to be transferred from said first feeding means to said second feeding means when said second feeding means is energized and thereafter, the second feeding means is deenergized until the leading edge of the next said sheet being fed by said first feeding means approaches said second feeding means, and thereafter, said second feeding means is energized to enable the next said sheet to be fed in overlapping relationship with the immediately prior said sheet.

3. The apparatus as claimed in claim 2 in which said first feeding means is positioned to enable said first direction to be substantially horizontal and said second feeding means is positioned to enable said second direction to be substantially vertical.

4. The apparatus as claimed in claim 3 in which said second feeding means includes an air means for moving the trailing edge of said immediately prior sheet out of the way of the leading edge of the next said sheet being fed to said second feeding means for feeding said sheets in overlapping relationship.

5. An apparatus comprising:

a receptacle for storing sheets;

moving means for moving said receptacle between loading and unloading positions in said apparatus;

said receptacle having a front end and a pusher plate means including a pusher plate for resiliently biasing sheets loaded into said receptacle towards said front end;

feeding means for feeding said sheets in overlapping relationship between said front end and said pusher plate when said receptacle is in said loading position; and pusher arm means for pushing sheets fed between said front end and said pusher plate towards said pusher plate;

said pusher plate means including:

a removable rack gear located in said receptacle;

a gear coupled to said pusher plate; and a one way clutch coupled between said gear and said rack gear to enable said pusher plate to be pushed away from said front end by said pusher arm means.

6. An apparatus for loading sheets into a receptacle, comprising:

a receptacle for storing said sheets;

said receptacle having a front end and a pusher plate means including a pusher plate for resiliently biasing sheets loaded into said receptacle towards said front end;

moving means for moving said receptacle between loading and unloading positions in said apparatus;

first feeding means for feeding said sheets in a continuous manner in spaced relationship in a first direction in said apparatus;

second feeding means for receiving said plurality of sheets from said first feeding means and for feeding said sheets in overlapping relationship in a second direction in said apparatus so as to load said sheets in overlapping relationship in said receptacle between said front end and said pusher plate when said receptacle is in said loading position;

control means for controlling the energization of said second feeding means;

said control means being effective to:

(a) energize said second feeding means when a said sheet from said first feeding means engages said second feeding means;

(b) deenergize said second feeding means when said sheet from said first feeding means is gripped by said second feeding means; and (c) energize said second feeding means when a next subsequent sheet being fed by said first feeding means engages said second feeding means to thereby feed said sheets in overlapping relationship in said second direction; and pusher arm means for pushing sheets fed between said front end and said pusher plate towards said pusher plate;

said pusher plate means including a one way clutch coupled to said pusher plate and said receptacle to enable said pusher plate to be moved only in a direction away from said front end by said pusher arm means when said receptacle is in said loading position.

7. The apparatus as claimed in claim 6 in which said first feeding means comprises first and second endless belt means including first and second endless belts, respectively, for feeding said sheets in said first direction, with said first feeding means having an entry end and an exit end; and said second feeding means comprises third and fourth endless belt means including third and fourth endless belts, respectively, for feeding said sheets in said second direction, with said second feeding means having an entry end and an exit end;

said exit end of said first feeding means being spaced from said entry end of said second feeding means; and with said exit end of said second feeding means being positioned in said receptacle when said receptacle is in said loading position.

8. The apparatus as claimed in claim 7 in which:

said first and second feeding means include a common shaft;

said second belt means includes a first pulley mounted on said common shaft;

said third belt means includes a second pulley mounted on said common shaft;

said second endless belt is mounted on said first pulley; and said fourth endless belt is mounted on said second pulley.

9. The apparatus as claimed in claim 6 in which said moving means includes:

a support means for pivotal supporting said receptacle;

means for pivoting said support means with said receptacle thereon between said loading and unloading positions;

latch means for latching said support means with said receptacle thereon in said loading position; and means for disengaging said latch means to enable said support means with said receptacle thereon to be moved to said unloading position where said receptacle is clear of said second feeding means.

10. An apparatus for loading sheets into a receptacle, comprising:

a receptacle for storing said sheets;

said receptacle having a front end and a pusher plate means including a pusher plate for resiliently biasing sheets loaded into said receptacle towards said front end;

moving means for moving said receptacle between loading and unloading positions in said apparatus;

first feeding means for feeding said sheets in a continuous manner in spaced relationship in a first direction in said apparatus;

second feeding means for receiving said plurality of sheets from said first feeding means and for feeding said sheets in overlapping relationship in a second direction in said apparatus so as to load said sheets in overlapping relationship in said receptacle between said front end and said pusher plate when said receptacle is in said loading position;

control means for controlling the energization of said second feeding means;

said control means being effective to:

(a) energize said second feeding means when a said sheet from said first feeding means engages said second feeding means;

(b) deenergize said second feeding means when said sheet from said first feeding means is gripped by said second feeding means; and )c) energize said second feeding means when a next subsequent sheet being fed by said first feeding means engages said second feeding means to thereby feed said sheets in overlapping relationship in said second direction; and pusher arm means for pushing sheets fed between said front end and said pusher plate towards said pusher plate;

said first feeding means comprising:

first and second endless belt means including first and second endless belts, respectively, for feeding said sheets in said first direction, with said first feeding means having an entry end and an exit end; and said second feeding means comprising:

third and fourth endless belt means including third and fourth endless belts, respectively, for feeding said sheets in said second direction, with said second feeding means having an entry end and an exit end; said exit end of said first feeding means being spaced from said entry end of said second feeding means; and with said exit end of said second feeding means being positioned in said receptacle when said receptacle is in said loading position;

said first and second feeding means including a common shaft;

said second belt means including a first pulley mounted on said common shaft;

said third belt means including a second pulley mounted on said common shaft;

said second endless belt being mounted on said first pulley; and said fourth endless belt being mounted on said second pulley;

said third endless belt means engaging a portion of the periphery of said second pulley.

11. The apparatus as claimed in claim 10 in which said second pulley has a diameter greater than the diameter of said first pulley.

12. The apparatus as claimed in claim 11 in which said control means includes a sensor means for generating a signal in response to a leading edge of a said sheet being fed by said first feeding means; and in which said control means is effective to energize said second feeding means a predetermined time after the receipt of said signal by said control means.

13. The apparatus as claimed in claim 12 in which said pusher arm means includes:

pusher arms for pushing said sheets fed between said front end and said pusher plate; and a solenoid coupled to said pusher arms;

said control means being effective to momentarily energize said solenoid in a periodic manner during the operation of said first feeding means.

14. The apparatus as claimed in claim 13 in which said pusher means also includes manually operable means for uncoupling said pusher arms from said solenoid to enable said pusher arms to moved out of said receptacle prior to said moving means moving said receptacle from said loading position to said unloading position.

15. A method of loading sheets into a receptacle in an apparatus, with said receptacle having a front end and a pusher plate for biasing sheets fed into said receptacle towards said front end; said method comprising the steps of:

(a) moving the receptacle from an unloading position to a loading position in said apparatus;

(b) feeding the sheets in overlapping relationship so that a discharge end of said overlapping sheets is positioned between said front end and said pusher plate when said receptacle is in said loading position; and (c) periodically pushing the overlapping sheets fed into said receptacle towards said pusher plate;

said pushing step being effected through using a one way clutch to enable said pusher plate to be moved in only one direction away from said front end when said receptacle is in said loading position.

16. The method as claimed in claim 15 in which said feeding step (b) is effected by:

(b-1) feeding said sheets in a continuous manner in spaced relation in a first direction by first conveyor belts in said apparatus;

(b-2) receiving a first of said sheets from step (b-1) in second conveyor belts;

(b-3) momentarily feeding said first sheet in a second direction by said second conveyor belts;

(b-4) receiving a second of said sheets from step (b-1) in said second conveyor belts;

(b-5) momentarily feeding said second of said sheets from step (b-1) in said second direction by said second conveyor belts to enable said first and said second of said sheets to be fed in partially overlapping relationship in said second direction so that said discharge end of said overlapping sheets is positioned between said front end and said pusher plate; and (b-6) repeating steps (b-1) through (b-5) for the remaining sheets being fed in said first direction.

17. The method as claimed in claim 16 in which said step (b-3) is effected by:

(b-3-1) using a flow of air to move the trailing edge of the first of said sheets out of the way of the leading edge of the second of said sheets.

* * * * *

UNITED STATES PATENT AND TRADEMARK OFFICE

CERTIFICATE OF CORRECTION

PATENT NO. : 5,288,066

DATED : February 22, 1994

INVENTOR(S) : David A. Hain

It is certified that error appears in the above-identified patent and that said Letters Patent is hereby corrected as shown below:

Column 9, line 58, "mans" should be --means--.

Column 13, line 29, after "step" insert --(c)--.

Signed and Sealed this

Second Day of August, 1994

*Attest:*

Bruce Lehman

BRUCE LEHMAN

*Attesting Officer*

*Commissioner of Patents and Trademarks*